US007063495B1

(12) United States Patent
Johnson

(10) Patent No.: US 7,063,495 B1
(45) Date of Patent: Jun. 20, 2006

(54) SPILL SHIELD FOR REFUSE COLLECTION VEHICLE

(75) Inventor: Gary L. Johnson, Ft. Payne, AL (US)

(73) Assignee: Delaware Captial Formation, Inc., Wilmington, DE (US)

( * ) Notice: Subject to any disclaimer, the term of this patent is extended or adjusted under 35 U.S.C. 154(b) by 0 days.

(21) Appl. No.: 10/768,196

(22) Filed: Jan. 30, 2004

Related U.S. Application Data

(62) Division of application No. 09/932,798, filed on Aug. 20, 2001, now abandoned.

(51) Int. Cl.
*B65F 1/16* (2006.01)

(52) U.S. Cl. ..... 414/511

(58) Field of Classification Search ..... 414/408, 414/511, 512, 525.6, 406, 407, 409, 410
See application file for complete search history.

(56) References Cited

U.S. PATENT DOCUMENTS

| | | | | |
|---|---|---|---|---|
| 3,170,377 | A | 2/1965 | Herpich et al. | |
| 3,211,309 | A | 10/1965 | Shubin | |
| 3,231,107 | A | 1/1966 | Clar | |
| 3,231,111 | A | 1/1966 | Clar | |
| 3,490,631 | A | 1/1970 | Smith | |
| 3,604,521 | A * | 9/1971 | Collins | 173/38 |
| 3,643,824 | A | 2/1972 | Partridge | |
| 3,687,313 | A | 8/1972 | Smith | |
| 3,768,672 | A | 10/1973 | Grooss | |
| 3,910,629 | A * | 10/1975 | Woodard | 296/101 |
| 4,552,500 | A | 11/1985 | Ghibaudo et al. | |
| 4,576,540 | A | 3/1986 | Derain et al. | |
| 4,611,848 | A * | 9/1986 | Romano | 296/98 |
| 4,648,775 | A | 3/1987 | Verner | |
| 4,773,457 | A | 9/1988 | Bierbrauer et al. | |
| 4,948,323 | A | 8/1990 | Gasparini | |
| 5,169,223 | A * | 12/1992 | Suzuki et al. | 312/330.1 |
| 5,807,043 | A | 9/1998 | Blank | |
| 6,059,511 | A | 5/2000 | Anderson et al. | |
| 6,146,079 | A | 11/2000 | Ghibaudo | |

* cited by examiner

*Primary Examiner*—Eileen D. Lillis
*Assistant Examiner*—Charles A. Fox
(74) *Attorney, Agent, or Firm*—Chambliss, Bahner & Stophel, P.C.

(57) ABSTRACT

A spill shield assembly for a refuse collection vehicle includes a slide panel assembly comprising a front slide panel and a rear slide panel. The assembly is applicable to vehicles having a refuse collection compartment, a refuse storage compartment and a packer ram assembly having a packer face plate. One of the front and rear slide panels of the spill shield assembly is adapted to slide over the other between an extended position in which the slide panels have no more than a small amount of overlap and are disposed generally horizontally when the packer face plate is in a rearward position and a retracted position in which the slide panels are significantly overlapped and are disposed at an angle so as to direct any material falling thereon into the collection compartment when the packer face plate is in a forward position.

19 Claims, 12 Drawing Sheets

SPILL SHIELD FOR REFUSE COLLECTION VEHICLE

FIELD OF THE INVENTION

This invention relates generally to vehicles that include a collection compartment for receipt of refuse and a packer ram for pushing the refuse into an adjacent storage compartment and compacting it therein. The invention provides a retractable spill shield that covers a portion of the collection compartment over and in front of the packer ram as the packer ram is extended to pack the refuse and retracted to permit refuse to be deposited in the compartment.

BACKGROUND AND DESCRIPTION OF THE PRIOR ART

Refuse collection vehicles that are employed to collect refuse (including recyclable materials) from collection containers are well-known. Such vehicles may include a container lifting assembly which engages and lifts a container into a dumping position over a collection compartment of the vehicle. The lifting assembly may be mounted on the front of the vehicle, on the rear of the vehicle or on the side of the vehicle. As used herein, the term "front of the vehicle" refers to the end of the vehicle where the cab is located and the term "rear of the vehicle" refers to the end of the vehicle opposite the front end. Refuse collection vehicles of this type generally include a packer ram that is used to push the refuse into an adjacent storage compartment and compact it, and which may also be used to eject the compacted refuse from the vehicle. The packer ram is generally located within the collection compartment or has a flat, angular or curved face assembly that forms a boundary wall of the collection compartment. A hydraulic cylinder or other force-applying mechanism is attached to the face assembly so that the face assembly may be extended to push the refuse into an adjacent storage compartment and compact it. In some cases, the face assembly may be further extended by the force-applying mechanism when desired to eject the compacted refuse from the vehicle. When fully retracted, however, the packer ram occupies some space on one end or side of or adjacent to the collection compartment. A removable or retractable top door is generally provided to cover the collection compartment and the components of the packer ram. However, when the top door is opened and the lifting assembly is engaged to lift a container into position for dumping (or when a container is otherwise lifted into position for dumping), it is possible for material from the container to fall onto the packer ram or in the collection compartment on the forward side (i.e. on the side away from or opposite the storage compartment) of the face assembly. Furthermore, when the packer ram is being extended to push the material into the storage compartment, some of such material may tend to ride up and over the packer ram to the forward side of the face assembly. Material that falls on the forward side of the face assembly may be difficult to remove and may interfere with the operation of the packer ram.

It is known to provide a shield to prevent refuse from falling onto the packer ram or in the collection compartment on the forward side of the face assembly. U.S. Pat. No. 3,170,377 of Herpich et al., U.S. Pat. No. 4,552,500 of Ghibaudo et al. and U.S. Pat. No. 4,648,775 of Verner all describe refuse collection vehicles of the type described above which include container lifting assemblies mounted on the front end and which are provided with such a shield. U.S. Pat. No. 3,211,309 of Shubin, U.S. Pat. No. 3,231,111 of Clar and U.S. Pat. Nos. 3,490,631 and 3,687,313, both of Smith, describe refuse collection vehicles having such a shield but no container lifting assembly. Instead of a front-mounted container lifting assembly, the vehicles of Shubin, Clar and Smith include a collection compartment that is accessible from the side of the vehicle.

The vehicle of U.S. Pat. No. 3,211,309 of Shubin includes a refuse collection compartment that has an opening in the bottom of a wall adjoining a refuse storage compartment through which a low-profile packer ram may be extended. The top of the packer ram cylinder is protected by a hinged cover that unfolds as the ram is pushed through the opening in the wall of the collection compartment into the storage compartment. U.S. Pat. No. 3,231,111 of Clar describes a vehicle having a packer ram assembly that is similar to that of Shubin. The collection compartment and adjacent storage compartment of the Clar vehicle are separated by a wall or partition having an opening at the bottom for the packer ram. The packer ram assembly includes a cylinder and a linkage system that is protected from intrusion of refuse within the collection compartment by a shield plate that is pivotally mounted at one end to one of the links of the linkage and arranged so that the free end slides across the top wall of the packer face assembly as the packer face is extended. U.S. Pat. No. 3,490,631 of Smith describes a refuse collecting vehicle that is similar to those of Shubin and Clar. A flexible cover is attached at one end to the packer ram of this vehicle for preventing refuse from dropping behind the packer ram as it is extended to push the refuse into an opening in the wall separating the collection compartment from the storage compartment. The other end of the flexible cover is attached by a spring-loaded system to the wall of the collection compartment opposite the storage compartment wall. U.S. Pat. No. 3,687,313, also of Smith, describes a shield for a refuse vehicle collection compartment that is similar to that described in U.S. Pat. No. 3,490,631. This shield is comprised of a flexible curtain that extends over a transversely-disposed, spring-loaded roller and is attached to a frame member within the wall of the collection compartment opposite the storage compartment wall. Another embodiment of the invention of Smith's '631 patent includes a sloping shield that slides across the top of the packer ram face assembly as the ram face plate is extended to push refuse into the storage compartment. U.S. Pat. No. 4,552,500 of Ghibaudo, et al. describes a refuse collection vehicle that may include a front-mounted container lifting assembly, or the container lifting assembly may be deleted to provide a collection compartment into which refuse may be loaded by hand from the side. The front-loading embodiment of the Ghibaudo vehicle includes a packer ram having an extended top plate which is contained within a canopy over the cab when the ram is fully retracted. The top plate is long enough to extend beneath the opening in the top of the collection compartment when the ram is extended to push refuse into the storage compartment. U.S. Pat. No. 4,648,775 of Verner describes a front-loading refuse collection vehicle which includes a packer ram having a face assembly which includes a shield plate that is hingedly attached to the upper portion of the ram. The other end of the shield plate is provided with shoes that slide within a guide channel on either side of the collection compartment.

All of these prior devices include one or more disadvantages. For example, the shield panels of Shubin, Clar and Smith (both versions) are adaptable, because of height restrictions, only to vehicles provided with a wall between the collection compartment and the storage compartment having an opening in the lower portion thereof for passage of a low-profile packer ram. The shield plate of Ghibaudo is a large heavy object which requires that the vehicle be provided with an equally large over-the-cab canopy. In addition, since the Verner shield plate is attached to and extends upwardly from the top of the packer ram in the compaction zone of the vehicle, it essentially forms the top portion of the packer face and would be subject to at least a portion of the resistance forces imposed by the refuse being packed into the storage compartment. The imposition of such forces would require, therefore, that the Verner shield possess the requisite strength and rigidity to overcome them. In addition, the guide channels of the Verner shield assembly extend nearly the full length of the collection compartment, which offers significant opportunities for refuse to be retained therein as refuse is dumped into the collection compartment and the packer ram is extended therethrough. Any such refuse that may become lodged in either or both of the guide channels may interfere with the operation of the shield or the packer ram.

It would be desirable if a packer shield could be developed for a refuse collection vehicle that would avoid the disadvantages of the previously-known devices.

ADVANTAGES OF THE INVENTION

Among the advantages of the invention is the provision of a spill shield assembly that may be used in connection with packer face plates of various heights. Yet another advantage of the invention is the provision of a spill shield assembly that may be installed in a vehicle with minimal change in the configuration of the conventional vehicle collection compartment. Still another advantage of the invention is the provision of a spill shield assembly which is comprised of components that are relatively easy and inexpensive to fabricate and install. Another advantage of the invention is the provision of a spill shield assembly which serves, when retracted, to direct material spilled from an overhead container into the collection compartment of a vehicle. Yet another advantage of the invention is the provision of a spill shield assembly which is shorter when retracted than when extended so as to reduce the height to which a refuse container must be raised to dump its contents into the collection compartment of a vehicle. Additional advantages of this invention will become apparent from an examination of the drawings and the ensuing description.

EXPLANATION OF TECHNICAL TERMS

As used herein, the term "collection compartment" refers to that portion of a refuse collection vehicle into which refuse may be deposited.

As used herein, the term "storage compartment" refers to that portion of a refuse collection vehicle into which refuse may be pushed by a packer ram from the collection compartment.

As used herein, the term "front", when used in reference to a vehicle, refers to the end of the vehicle where the cab is located.

As used herein, the term "rear", when used in reference to a vehicle, refers to the end of the vehicle opposite the front end.

As used herein, the term "forward", when used in reference to a collection compartment, refers to the side of the collection compartment opposite the storage compartment or to a direction towards such side. The "forward" side of the collection compartment is the side away from which the packer face moves as the packer ram is extended.

As used herein, the term "rearward", when used in reference to a collection compartment, refers to the side of the collection compartment adjacent to the storage compartment, or to a direction towards such side. The "rearward" side of the collection compartment may or may not be defined by a separating wall or partition, and is the side towards which the packer face moves as the packer ram is extended.

As used herein, the term "side wall", when used in reference to a collection compartment, refers to a side of the collection compartment that is generally parallel to the direction of movement of the packer ram. The "side walls" of a collection compartment may be contiguous with side walls of an adjacent storage compartment.

As used herein, the term "roller", when used in reference to the invention, refers to a wheel mounted on an axle or a shoe or slide that is adapted to move with minimal resistance along the ramp.

SUMMARY OF THE INVENTION

The invention comprises a spill shield assembly for a refuse collection vehicle having a refuse collection compartment, a refuse storage compartment and a packer ram assembly having a packer face plate. The spill shield assembly includes a slide panel assembly comprising a front slide panel and a rear slide panel. One of the front and rear slide panels is adapted to slide over the other between an extended position in which the slide panels have no more than a small amount of overlap and are disposed generally horizontally when the packer face plate is in a rearward position and a retracted position in which the slide panels are significantly overlapped and are disposed at an angle so as to direct any material falling thereon into the collection compartment when the packer face plate is in a forward position. The preferred embodiment of the assembly also includes a pair of ramps, one of which is attached to each of the side walls of the collection compartment, and a pair of front rollers which are attached to the front slide panel and adapted to engage the ramps as the front and rear slide panels move between the extended position and the retracted position. A pair of links are provided in the preferred embodiment, each of which has a front end and a rear end. The front end of each link is pivotally attached to the front slide panel and the rear end of each link is pivotally attached to the packer face plate. The links, the front rollers and the ramps of the preferred embodiment are arranged so that when the packer face plate of the packer ram assembly is in the forward position, the slide panel assembly is in the retracted position, and so that when the packer face plate is in the rearward position, the slide panel assembly is in the extended position and covers a substantial portion of the top of the collection compartment forward of the packer face plate.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
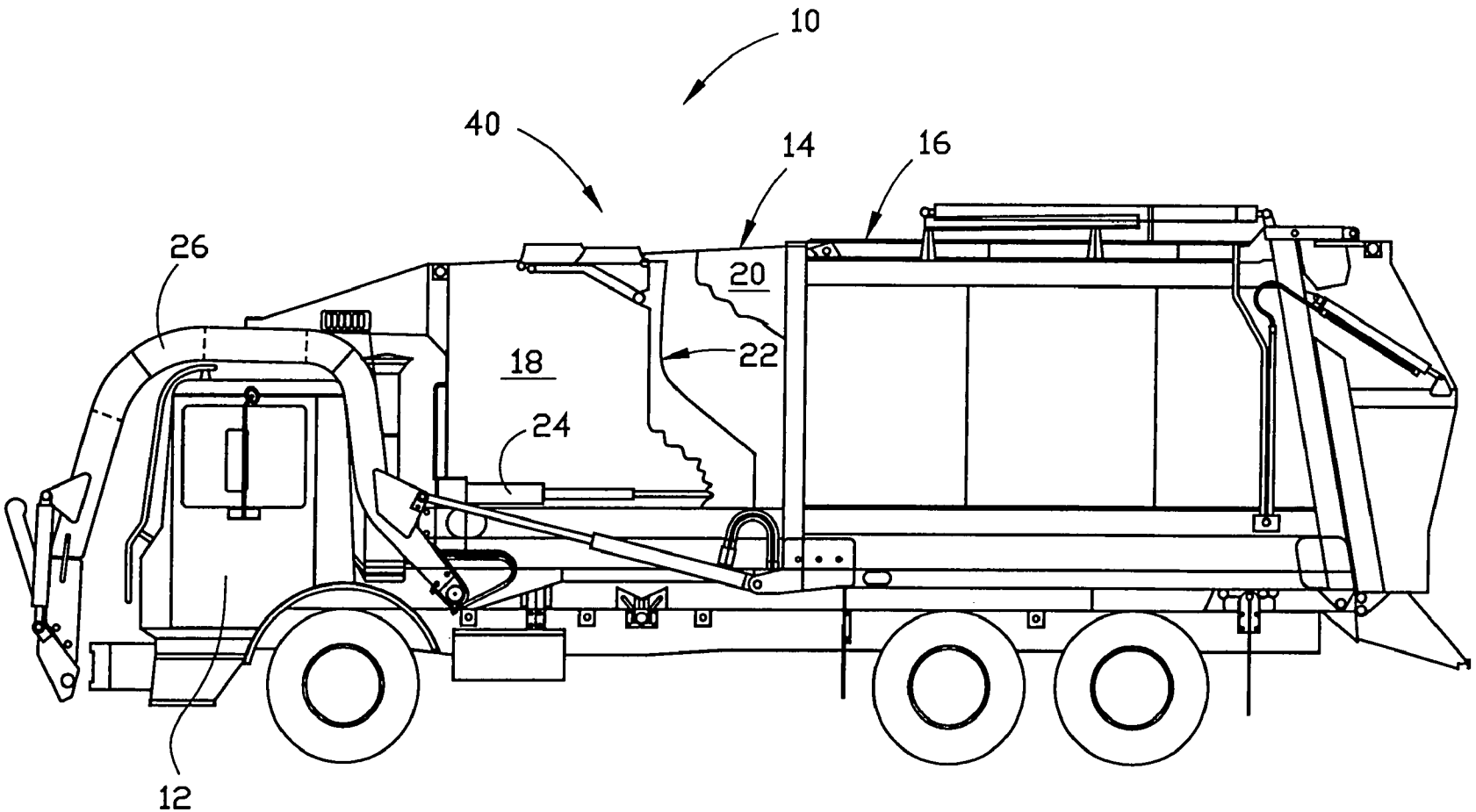
FIG. 1 is a side view of a front loader refuse truck with the left side panel of the collection compartment removed to illustrate the invention in place in front of a packer panel that is in a rearward position.
Figure 2:
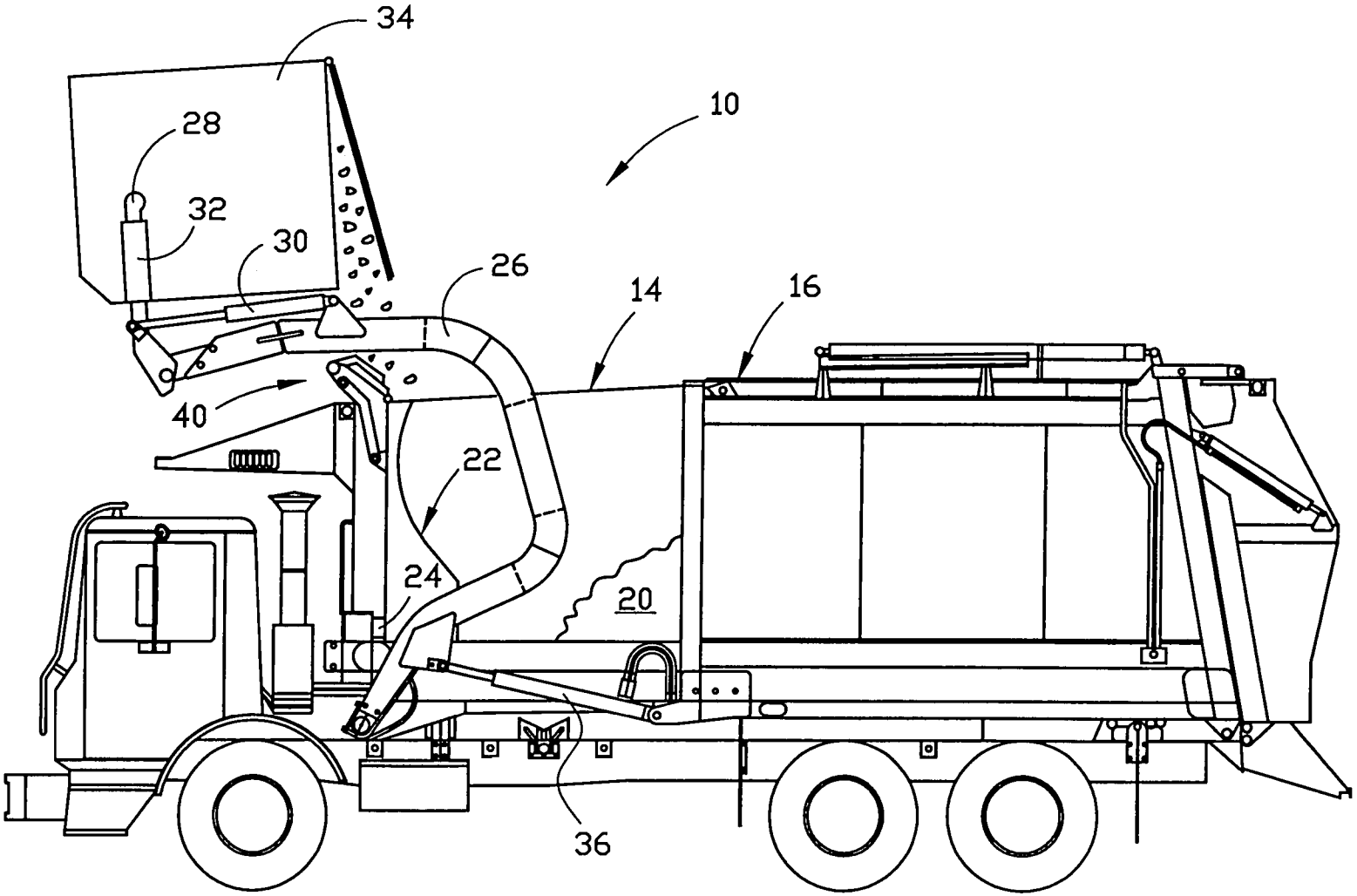
FIG. 2 is a is a side view of the truck of FIG. 1 illustrating the invention in place above and in front of a fully-retracted packer panel as a refuse container is being lifted above the cab of the truck.
Figure 3:
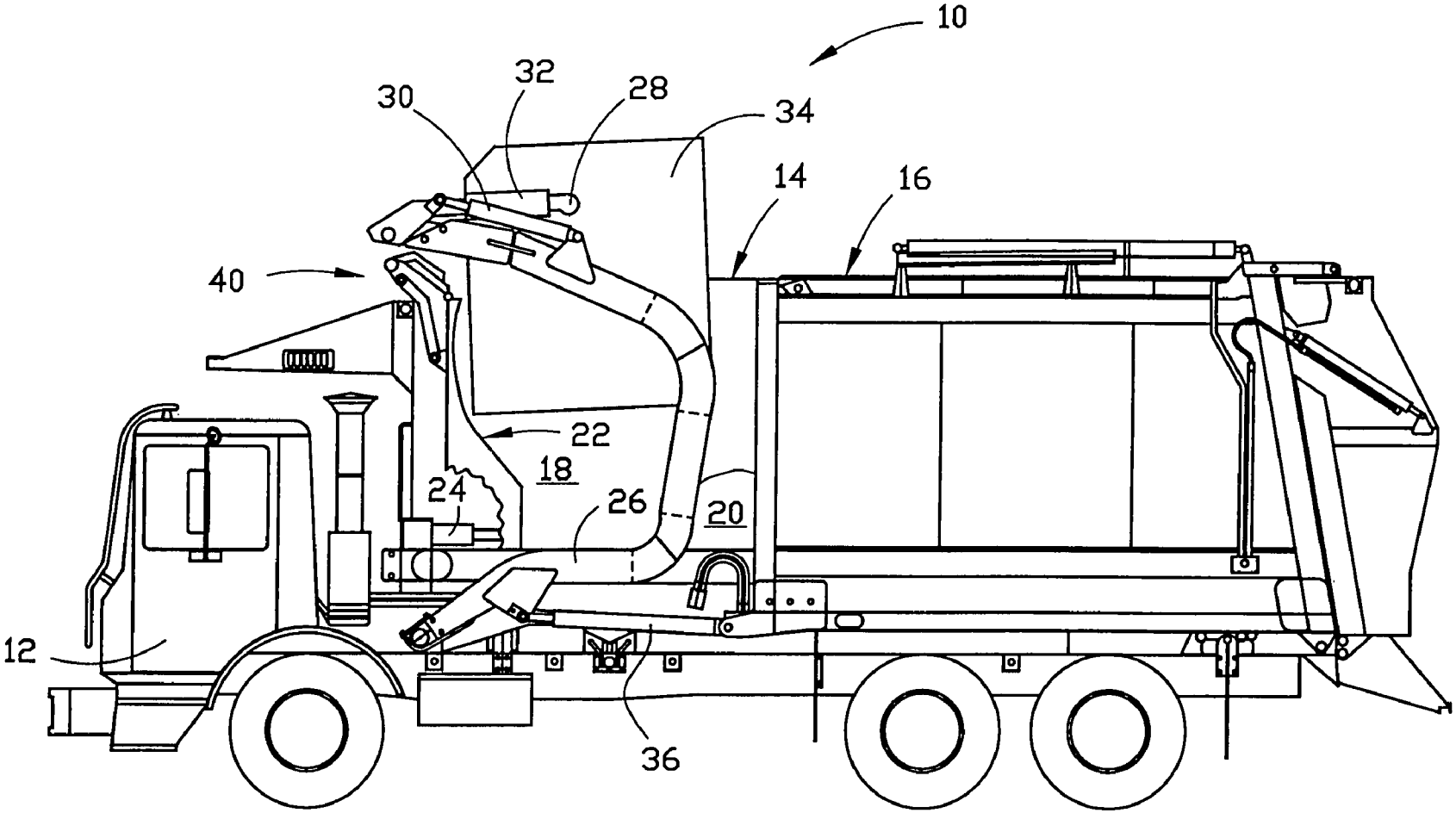
FIG. 3 is a is a side view of the truck of FIGS. 1 and 2 illustrating the invention in place above and in front of a fully-retracted packer panel as the contents of a refuse container are being dumped into the collection compartment of the truck.

FIGS. 1, 2 and 3 illustrate a refuse collection vehicle which includes the invention. As shown therein, vehicle 10 includes cab 12, refuse collection compartment 14 and storage compartment 16. The collection compartment is provided with a retractable cover (not shown) which slides over the top of the compartment. Collection compartment 14 is defined by in part by a pair of side walls 18 and 20, although in the drawings, side wall 20 is partially cut away for clarity. The storage compartment is adjacent to the collection compartment, and in the embodiment of the vehicle illustrated in the drawings, to the rear of the collection compartment on the vehicle. The storage compartment does not typically include a retractable cover and may be defined in part by side walls that are continuations of side walls 18 and 20. The vehicle includes a packer ram assembly that is generally conventional and includes packer face plate 22 and a force-applying mechanism that is preferably comprised of a pair of multi-stage double-acting telescopic hydraulic cylinders such as cylinder 24. The packer ram assembly is shown partially cut away in FIGS. 1 and 3 to reveal cylinder 24. Telescopic hydraulic cylinders may be particularly useful when the packer ram is designed to fully eject the refuse from the collection compartment and therefore must extend the entire length of the storage compartment. When the vehicle is provided with a hoist for raising the front of the storage compartment to dump the material contained therein (not shown), one or more single-stage cylinders may be employed as the force-applying mechanism.

As illustrated by comparing FIGS. 1, 2 and 3, the force-applying mechanism of the invention is adapted to move the packer face plate across at least a substantial portion of the collection compartment between a forward position in which the packer face plate is disposed at the side of the collection compartment opposite the storage compartment (shown in FIGS. 2 and 3) and a rearward position in which the packer face plate is disposed adjacent to the storage compartment (shown in FIG. 1). Of course, if the packer is designed to eject the refuse from the storage compartment, the rearward position shown in FIG. 1 will only be an intermediate position, and the packer ram may be pushed into a further rearward position (not shown) at the rear of the truck.

Vehicle 10 is provided with a front-mounted container-lifting assembly comprised of a pair of lifting arms 26 (only one of which is shown) and forks 28 (only one of which is shown). The container-lifting assembly also includes a pair of hydraulic cylinders 30 (only one of which is shown) which may be extended to rotate the forks in order to engage the container sleeves 32 (only one of which is shown in FIGS. 2 and 3) on a container such as container 34. The container-lifting assembly also includes a pair of hydraulic cylinders 36 (only one of which is shown) which may be actuated to raise and lower arms 26 between the lowered position shown in FIG. 1 to the intermediate position shown in FIG. 2 and the dumping position of FIG. 3.

Although not shown in the drawings, the invention may also be used in connection with a refuse collection vehicle having side-mounted or rear-mounted container-lifting assemblies, or a vehicle that is not equipped with a lifting assembly, or a vehicle in which the packer ram moves from side to side across the vehicle, or a vehicle in which the packer ram moves from a retracted position nearer the rear end of the vehicle to an extended position nearer the cab, so long as the vehicle has a refuse collection compartment, an adjacent storage compartment, and a packer ram assembly that is adapted to move a packer face across at least a substantial portion of the collection compartment towards the storage compartment.

The invention comprises spill shield assembly 40, which is adapted for preventing refuse from falling in the collection compartment on the forward side of the packer face plate in a refuse collecting vehicle such as vehicle 10. The preferred assembly is illustrated in detail in FIGS. 4–12. As shown therein, the assembly includes front slide panel 42 and rear slide panel 44. The slide panels may be made of metal, plastic or other suitable material, and are mounted so that one of the slide panels is adapted to slide over the other between an extended position in which the slide panels have no more than a small amount of overlap (as shown in FIGS. 1, 4–7 and 9–12) and a retracted position in which the slide panels are significantly overlapped, as shown in FIGS. 2 and 3. Preferably, the front slide panel is adapted to slide over the rear slide panel (when viewed from the top) between the extended position and the retracted position. The amount of overlap of the panels at these positions is not critical. However, maximizing the overlap in the retracted position and minimizing the overlap at the extended position will permit the use of slide panels of minimum width, as measured in the direction between the forward and rearward sides of the collection compartment.

Figure 6:
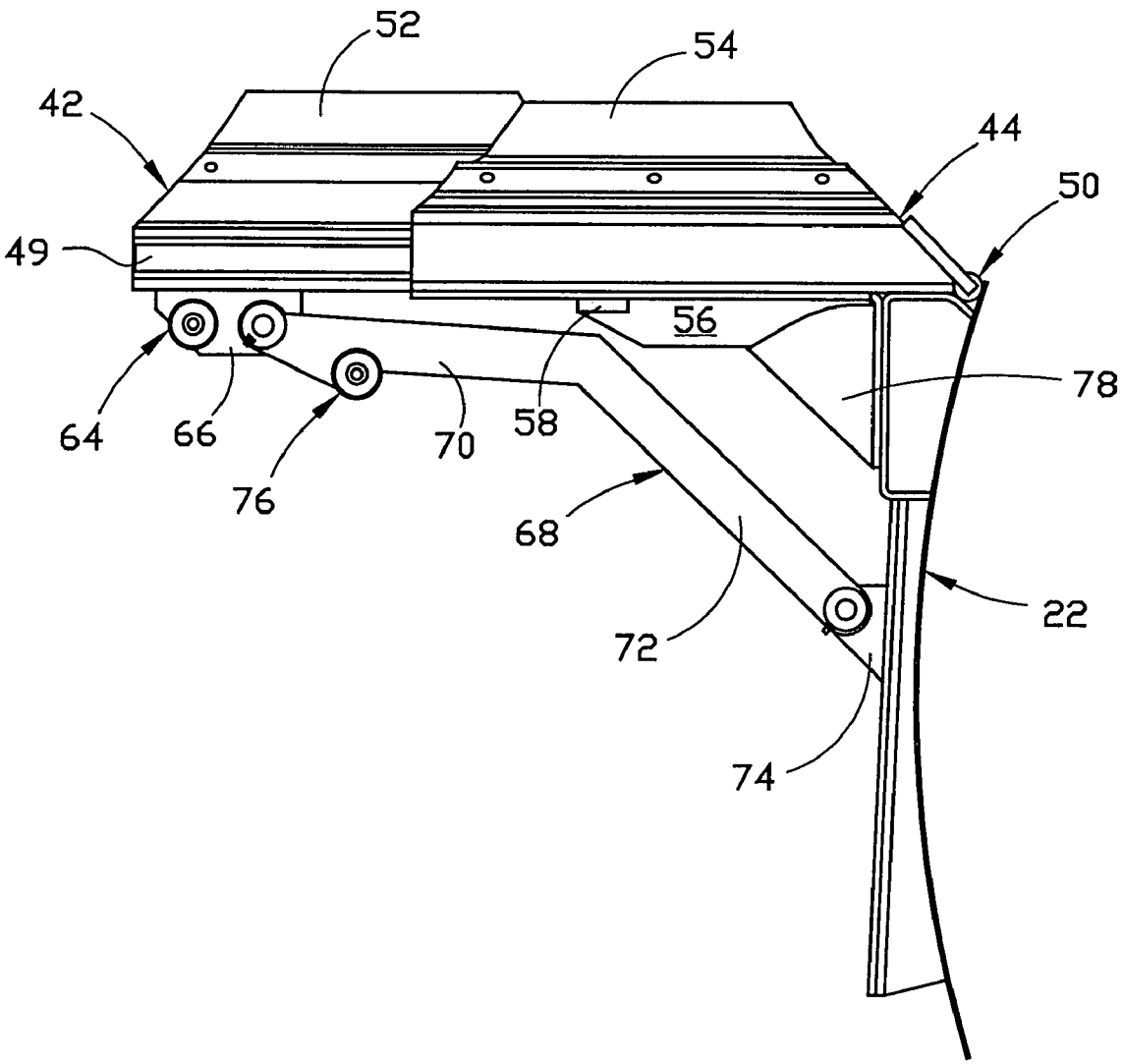
FIG. 6 is a side view of most of the components of a preferred embodiment of the invention.
Figure 7:
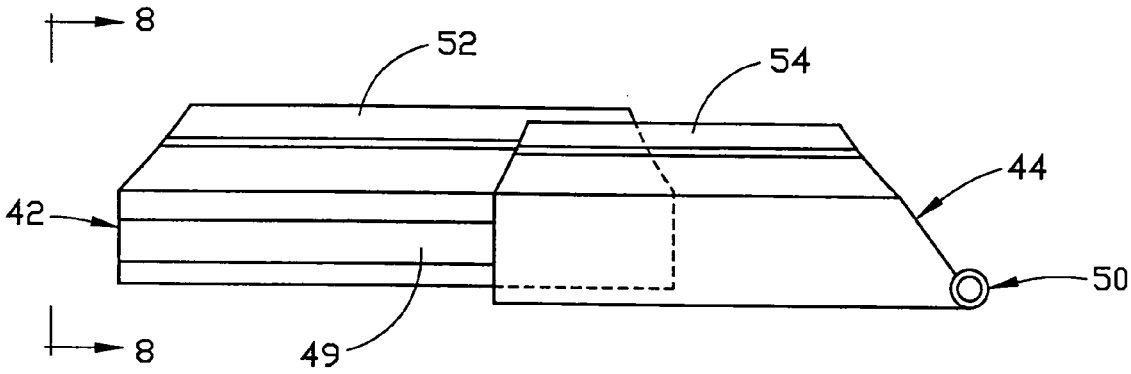
FIG. 7 is a side view of the front and rear slide panels of the invention.
Figure 8:
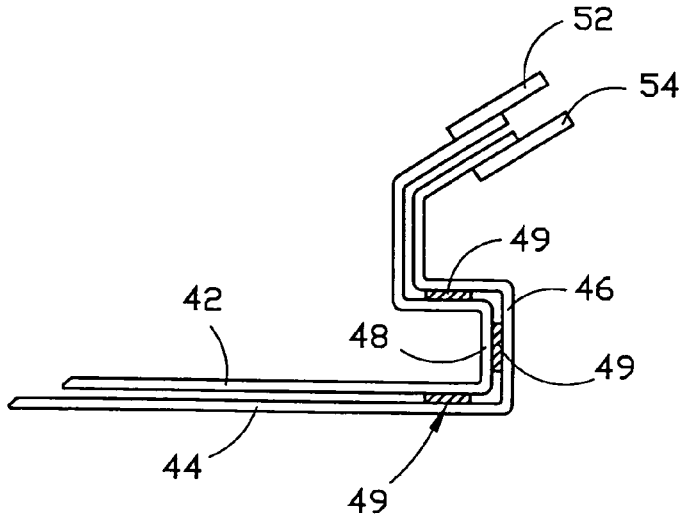
FIG. 8 is a partial end view of the front and rear slide panels of FIG. 7, as taken along line 8—8 of FIG. 7.

FIGS. 7 and 8 show in some detail the interrelationship between preferred front slide panel 42 and preferred rear slide panel 44. As shown therein, the front panel is formed with a generally U-shaped guide 48, and the rear panel is formed with a corresponding guide receiver 46. Guide 48 fits within receiver 46 and is adapted to slide within the receiver as the front and rear slide panels move between the extended position and the retracted position. It is also preferred that ultra-high molecular weight plastic wear strips such as side strip 49 be provided on the side, top and bottom of guide 48 to reduce friction as the slide panels move between the extended and retracted positions. It is also preferred that rear slide panel 44 be pivotally attached to the top of packer face plate 22, such as by means of hinge 50 (see FIGS. 6, 7 and 12).

Preferably, the front and rear slide panels are provided with elastomeric sealing gaskets 52 and 54 respectively on each side. These gaskets engage and slide along the side walls of the collection compartment as the slide panels move between the extended position and the retracted position, so as to prevent any refuse that may fall on the slide panels from getting beneath them. Preferably, gaskets 52 and 54 will maintain contact with the side walls of the collection compartment as the packer extends and retracts, compensating for any side-to-side movement of the packer in the collection compartment.

Figure 4:
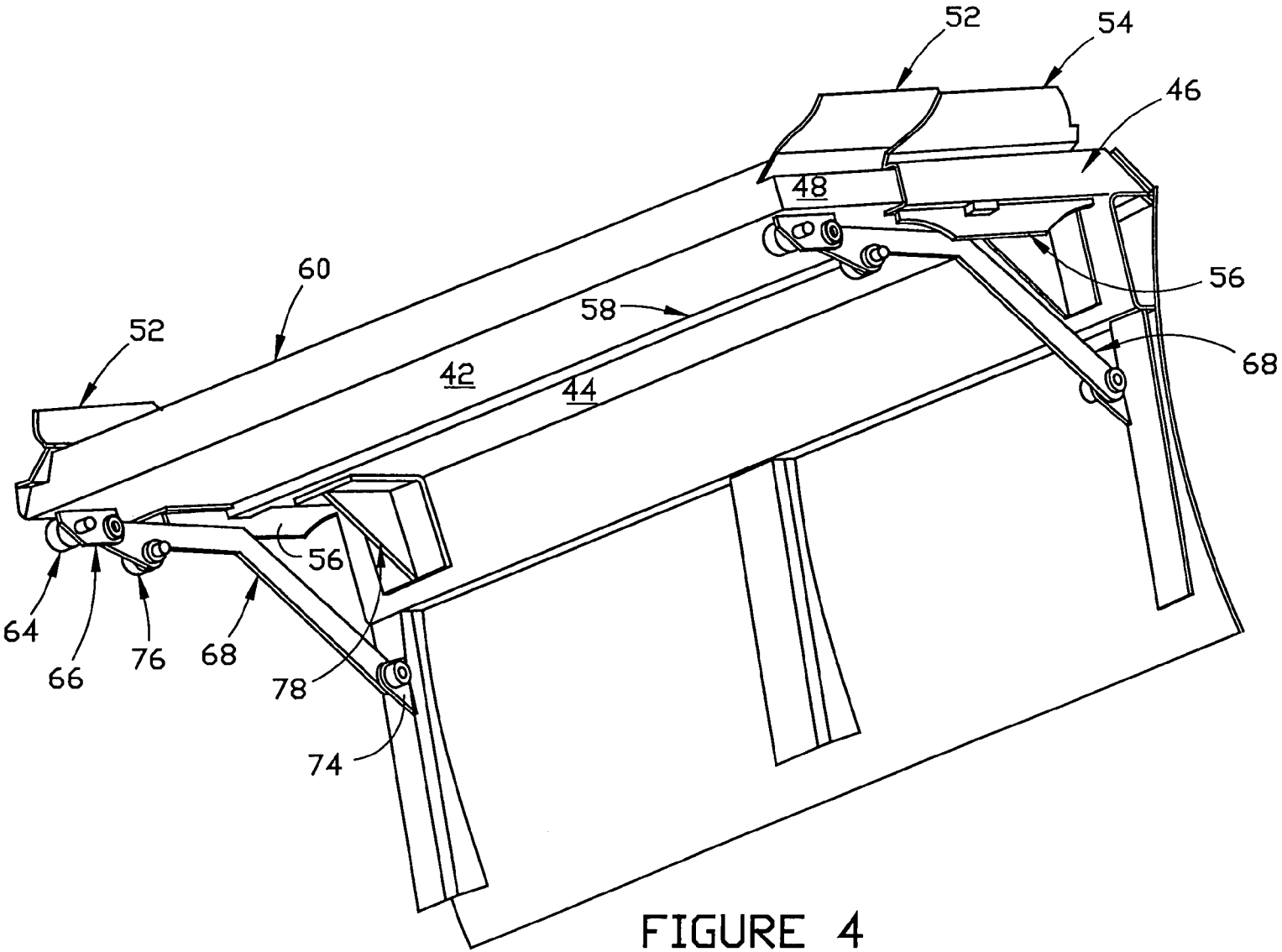
FIG. 4 is a perspective view of most of the components of a preferred embodiment of the invention, as seen from the forward side of the collection compartment of a vehicle such as is illustrated in FIGS. 1, 2 and 3.
Figure 5:
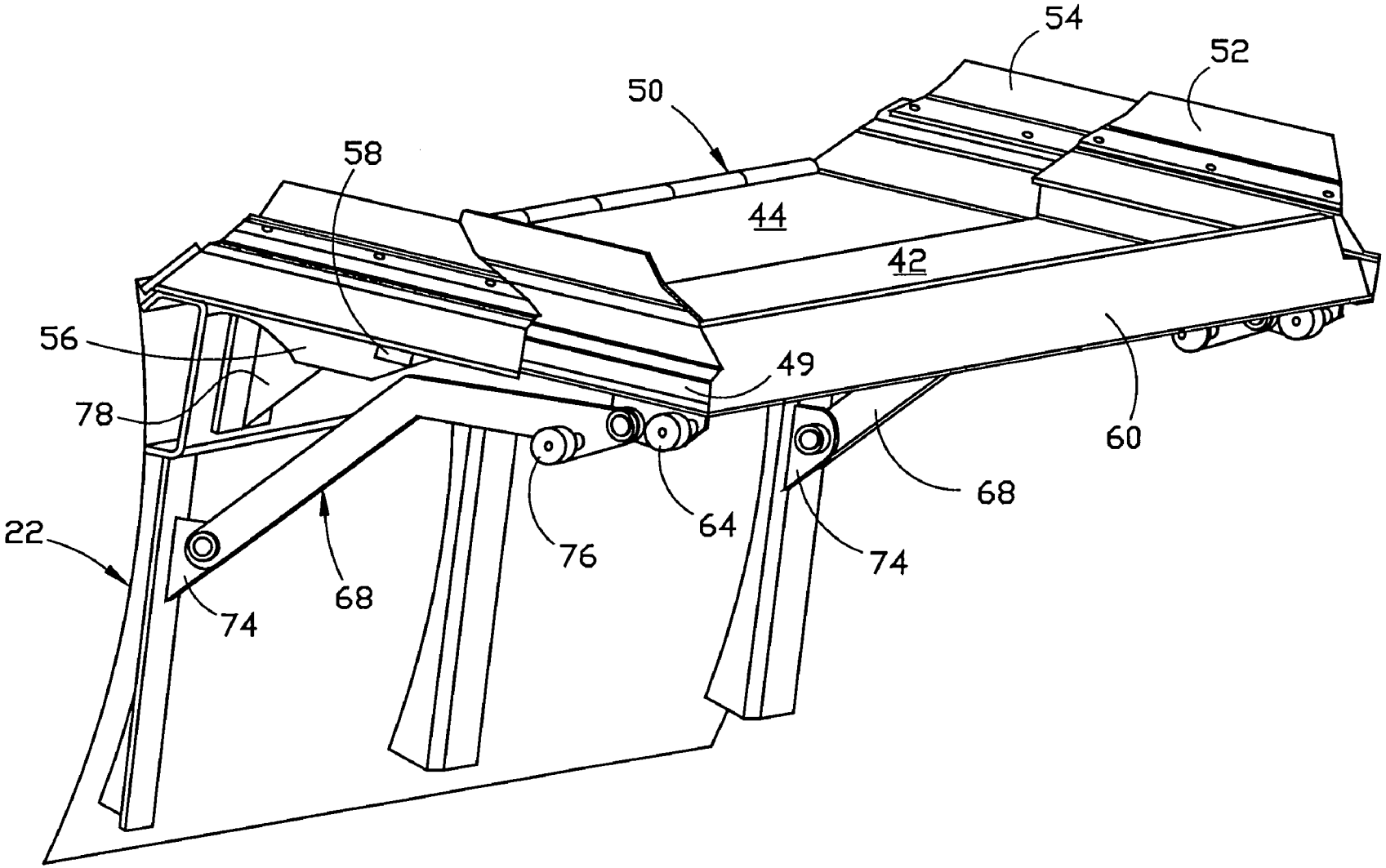
FIG. 5 is a perspective view of most of the components of a preferred embodiment of the invention, as seen from a slightly different perspective from that of FIG. 4.

The preferred embodiment of the invention also includes a support assembly to provide rigidity for the spill shield assembly. As shown in FIGS. 4 and 6, the preferred support assembly is comprised of side supports 56 (one of which is partially shown, for clarity, in FIG. 6) on each side of the assembly adjacent to the side walls of the collection compartment and support beam 58 extending between the side supports. The side supports of the preferred embodiment are attached to the lower portion of rear slide panel 46 at opposite sides. Front slide panel 42 also preferably includes upstanding dam 60 (shown in FIGS. 4, 5, 11, and 12), that is preferably provided with a generally rectangular cross-section, which helps to insure that any refuse on the top of the slide panels falls on the rearward side of the packer face plate (towards the storage compartment) as the slide panels move to the retracted position.

Figure 9:
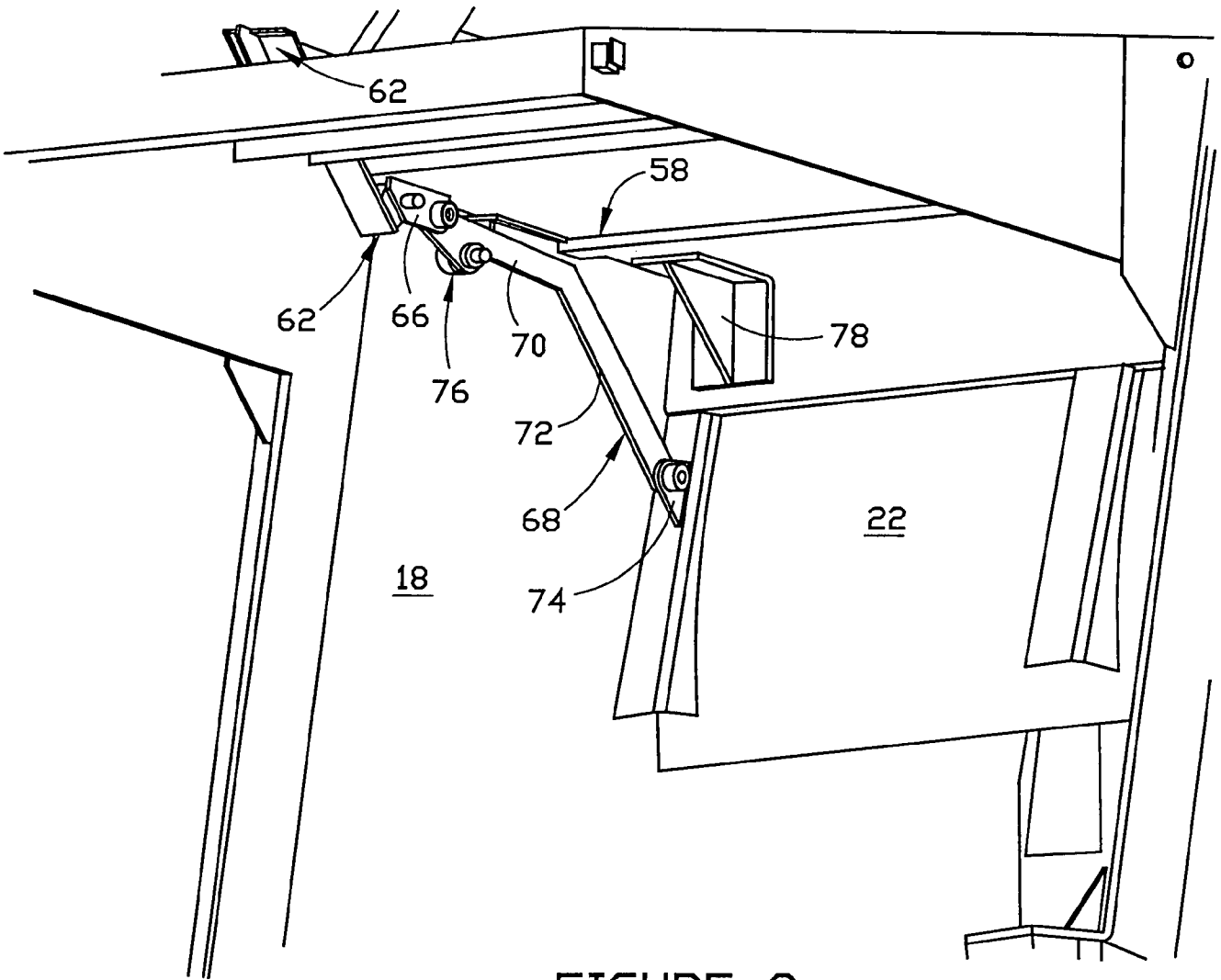
FIG. 9 is a perspective view similar to that of FIGS. 3 and 4, but showing the preferred embodiment of the invention mounted within the collection compartment of a vehicle such as is illustrated in FIGS. 1, 2 and 3.
Figure 10:
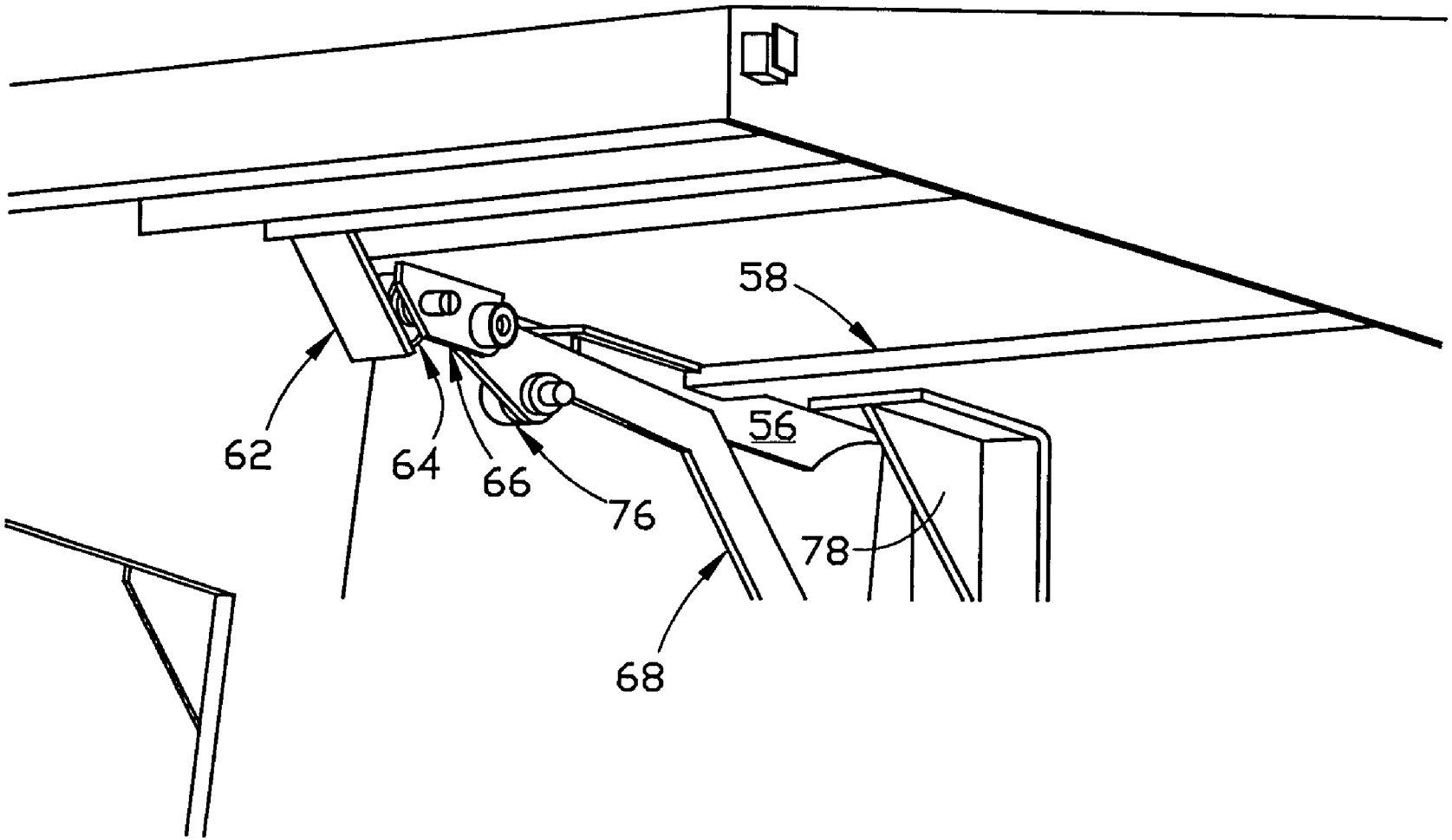
FIG. 10 is an enlarged view of a portion of the embodiment of the invention illustrated in FIG. 9.
Figure 11:
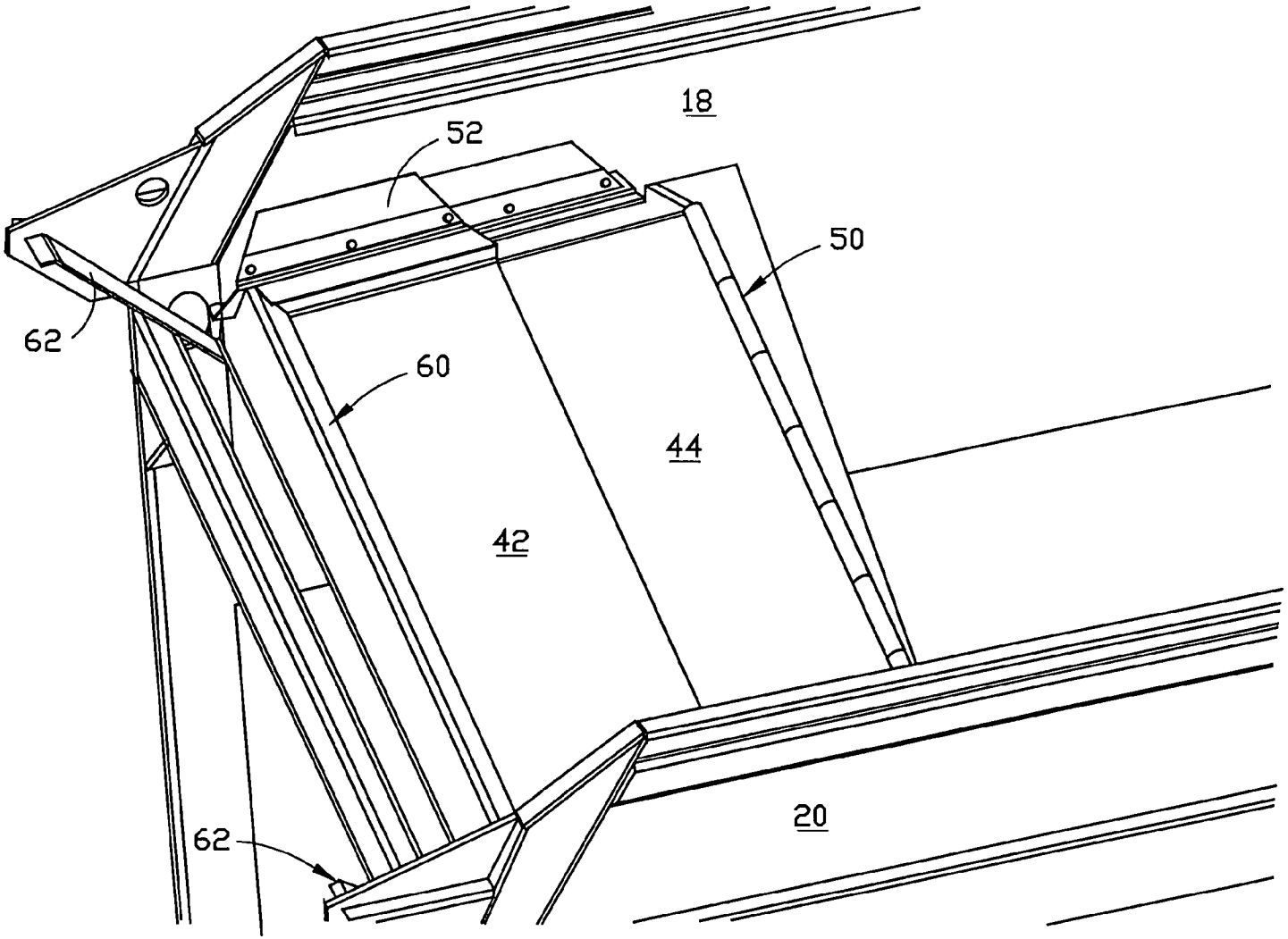
FIG. 11 is a perspective view of some of the components of a preferred embodiment of the invention, as seen from a different perspective from that of FIGS. 9 and 10.
Figure 12:
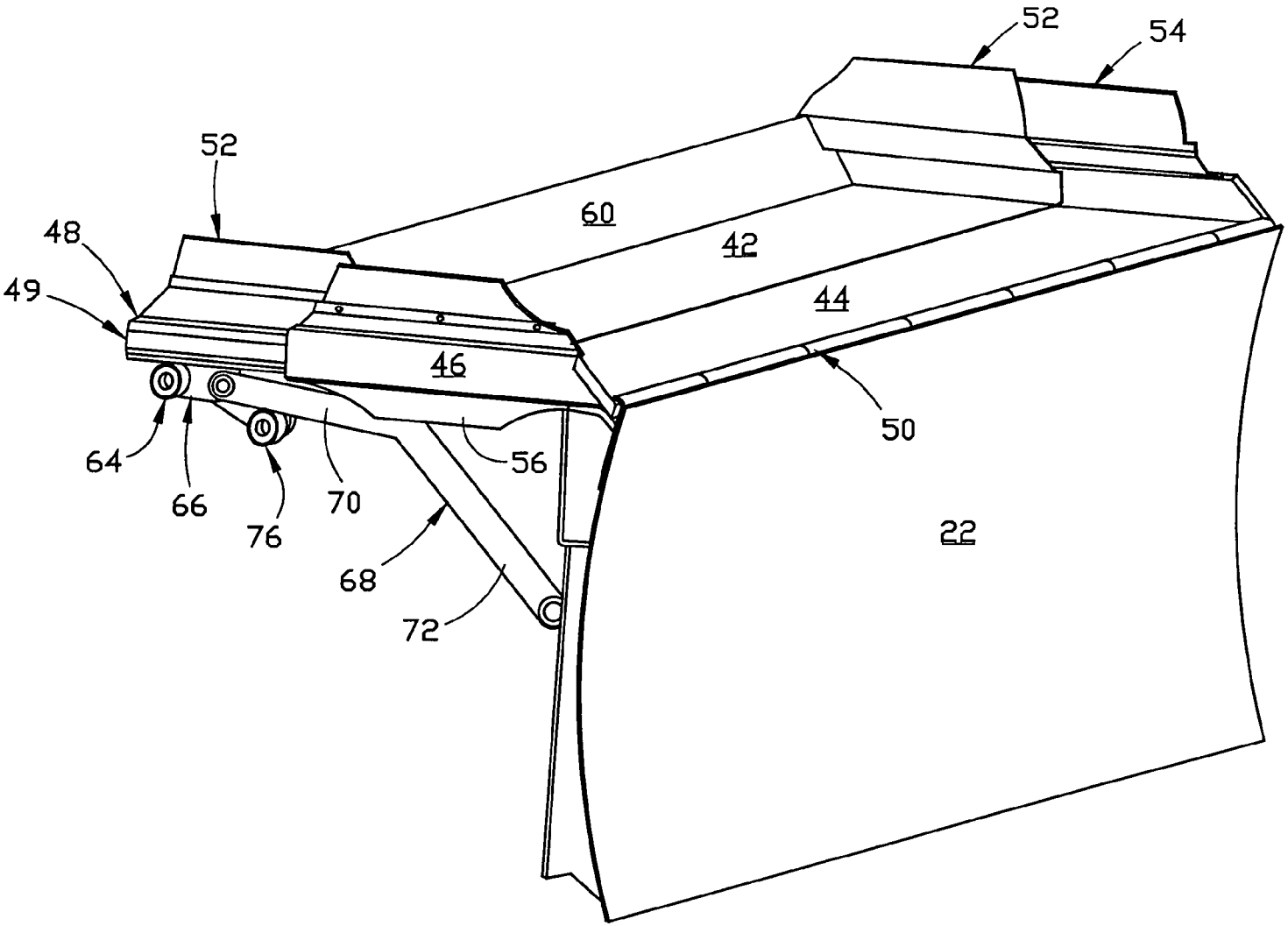
FIG. 12 is a perspective view of most of the components of a preferred embodiment of the invention, as seen from the storage compartment of a vehicle such as is illustrated in FIGS. 1, 2 and 3.

The preferred spill shield assembly includes a pair of ramps 62, as shown in FIGS. 9–11, one of which is attached to each of the side walls of the collection compartment, preferably by welding. Preferably, the ramps are disposed at an angle of about 45° from the horizontal, although the ramps may be disposed at any convenient angle. A pair of front rollers 64 are preferably attached to the front slide panel and adapted to engage the ramps as the front and rear slide panels move between the extended position and the retracted position. Preferably, the front rollers are mounted to the front slide panel on a pair of brackets 66, one of which is attached at each side of the forward end of the front slide panel. The preferred assembly also includes a pair of links 68, each of which has front component 70 and rear component 72. The front component at the front end of each link 68 is pivotally attached to the front slide panel, preferably by attachment to bracket 66 behind or rearwardly of the front roller. The rear component at the rear end of each link 68 is pivotally attached to the packer face plate, preferably by means of bracket 74. As best shown in FIGS. 1 and 6, front component 70 of preferred link 68 is generally horizontally disposed and rear component 72 is generally disposed at an angle of about 45° from the horizontal when the slide panels are in the extended position. The preferred assembly also includes a pair of rear rollers 76, if ramps, front rollers and links are employed. Each rear roller is attached to a link 68. The rear rollers are adapted to engage the ramps as the front and rear slide panels move between the extended position and the retracted position. Links 68, front rollers 64, rear rollers 76 and ramps 62 of the preferred assembly are arranged so that when the packer face plate is in the forward position, the slide panel assembly is in the retracted position, and preferably covers a substantial portion of the top of the collection compartment forward of the packer face plate. Preferably, when in the retracted position, the slide panels of the preferred slide panel assembly are disposed at an angle of about 45° to the horizontal. This preferred angle is not critical, but the spill shield assembly should be disposed at an angle so as to direct material that begins to fall from a container as it is being lifted over the cab of the vehicle into the collection compartment.

Figure 13:
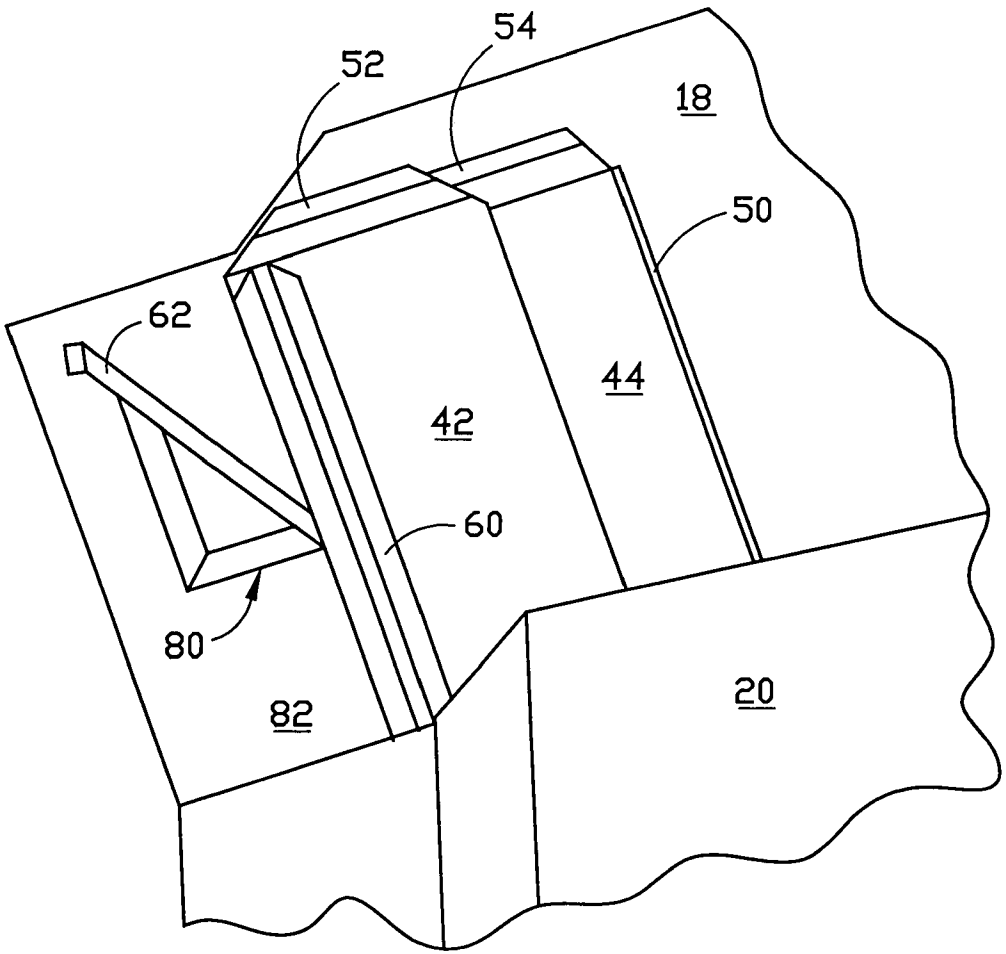
FIG. 13 is a perspective view, similar to that of FIG. 11, of an alternative embodiment of one of the components of the invention.

An alternative embodiment of the ramp arrangement of the invention is illustrated in FIG. 13. In this embodiment, a single ramp 62 is mounted generally along the centerline of the collection compartment (midway between walls 18 and 20) at the forward side, preferably by welding. Preferably, the ramp is disposed at an angle of about 45° from the horizontal, although it may be disposed at any convenient angle. Since the ramp is not attached to either of walls 18 or 20, it is preferably supported by support structure 80 which is attached to cab shield 82. In this embodiment of the invention, a front roller 64 is preferably attached to front slide panel 42 (see FIG. 6) and adapted to engage the ramp as the front slide panel and rear slide panel 44 move between the extended position and the retracted position. Preferably, the front roller is mounted to the front slide panel on a bracket 66 which is attached at the forward end of the front slide panel. This embodiment of the invention may also include a link 68 which has front component 70 and rear component 72. The front component at the front end of the link 68 is pivotally attached to the front slide panel, preferably by attachment to bracket 66 behind or rearwardly of the front roller. The rear component at the rear end of the link 68 is pivotally attached to the packer face plate, preferably by means of bracket 74. Front component 70 of preferred link 68 is generally horizontally disposed and rear component 72 is generally disposed at an angle of about 45° from the horizontal when the slide panels are in the extended position. This embodiment of the invention may also include a rear roller 76 which is attached to link 68. The rear roller is adapted to engage the ramp as the front and rear slide panels move between the extended position and the retracted position. Link 68, front roller 64, rear roller 76 and ramp 62 of this embodiment of the invention are arranged so that when the packer face plate is in the forward position, the slide panel assembly is in the retracted position, and preferably covers a substantial portion of the top of the collection compartment forward of the packer face plate. Preferably, when in the retracted position, the slide panels of this embodiment of the invention are disposed at an angle of about 45° to the horizontal. This preferred angle is not critical, but the spill shield assembly should be disposed at an angle so as to direct material that begins to fall from a container as it is being lifted over the cab of the vehicle into the collection compartment.

As shown in FIGS. 2 and 3, when the invention is employed in connection with a vehicle having a front-mounted container-lifting assembly, the slide panel assembly does not interfere with the movement of the container-lifting assembly or the dumping of refuse from the container when the packer face plate is in the forward position. As shown in FIGS. 4–6 and 9–11, links 68, front rollers 64, rear rollers 76 and ramps 62 are also arranged so that when the packer face plate is in the rearward position, the slide panel assembly is in the extended position and covers a substantial portion of the top of the collection compartment forward of the packer face plate. When in the extended position, the slide panels of the slide panel assembly are disposed generally horizontally. It is also preferred that support 78 is mounted to packer face plate 22 to provide support for the rear slide panel in the extended position. In operation, when the packer face plate is retracted, the front slide panel will slide with respect to the rear slide panel as the front and rear rollers engage and ride along the ramps. As shown in FIGS. 2 and 3, when the slide panel assembly is in the retracted position, there is substantial overlap of the panels, which are disposed at an angle of approximately 45° to the horizontal. In this position, the panels are substantially above the top edge of the packer face plate. This position allows the lifting arms 26 to lift container 34 above the vehicle for dumping of its contents into the collection compartment. As shown in FIG. 2, this position also allows the spill shield assembly to direct material that begins to fall from a container as it is being lifted over the cab of the vehicle into the collection compartment, instead of allowing it to fall in front of the packer face plate. As the packer ram moves the packer face plate toward the extended position, the rollers roll down the ramp, and the rear slide panel extends from (or with respect to) the front slide panel. As the spill shield assembly moves to the extension position, the angle of the preferred panels changes from approximately 45° to the horizontal to a substantially horizontal position. When fully extended, the spill shield panel assembly is between approximately one and a half times and approximately two times as long as it is in its retracted condition. As the packer ram begins to retract, the front and rear slide panels slide across each other, and the dam on the forward end of the front slide panel prevents any refuse that may have fallen on the panels from spilling onto the forward side the packer ram.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A spill shield assembly for a refuse collection vehicle, said vehicle having:

(a) a refuse collection compartment that is defined in part by a pair of side walls;

(b) a refuse storage compartment that is located adjacent to the refuse collection compartment;

(c) a packer ram assembly including:

(i) a packer face plate;

(ii) a force-applying mechanism that is adapted to move the packer face plate across at least a substantial portion of the collection compartment between a forward position in which the packer face plate is disposed at the side of the collection compartment opposite the storage compartment and a rearward position in which the packer face plate is disposed adjacent to the storage compartment;

said spill shield assembly comprising:

(d) a slide panel assembly comprising a front slide panel and a rear slide panel, wherein one of the front and rear slide panels is adapted to slide over the other between an extended position in which the slide panels are disposed generally horizontally when the packer face plate is in a rearward position and a retracted position in which the slide panels are overlapped and are disposed at an angle so as to direct any material falling thereon into the collection compartment when the packer face plate is in a forward position;

(e) a ramp which is mounted on the forward side of the collection compartment;

(f) a front roller which is attached to the front slide panel and adapted to engage the ramp as the front and rear slide panels move between the extended position and the retracted position;

(g) a link having a front end and a rear end, wherein the front end of the link is pivotally attached to the front slide panel and the rear end of the link is pivotally attached to the packer face plate;

wherein the link, the front roller and the ramp are arranged so that when the packer face plate is in the forward position, the slide panel assembly is in the retracted position; and wherein the link, the front roller and the ramp are arranged so that when the packer face plate is in the rearward position, the slide panel assembly is in the extended position and covers a substantial portion of the top of the collection compartment forward of the packer face plate.

2. The spill shield assembly of claim 1 wherein:

(a) the vehicle includes a front-mounted container-lifting assembly which is adapted to lift a container into a position over the collection compartment so that the contents of the container may be dumped into the collection compartment; and (b) the link, the front roller and the ramp are arranged so that when the packer face plate is in the forward position, the slide panel assembly does not interfere with the movement of the container-lifting assembly or the dumping of refuse from the container.

3. The spill shield assembly of claim 1 wherein the front slide panel is adapted to slide over the rear slide panel between an extended position in which the front slide panel and the rear slide panel are disposed generally horizontally and a retracted position in which the front slide panel significantly overlaps the rear slide panel.

4. The spill shield assembly of claim 1 wherein the link comprises a front component and a rear component and wherein the front component is generally horizontally disposed and the rear component is generally disposed at an angle of about 45° from the horizontal when the slide panels are in the extended position.

5. The spill shield assembly of claim 1 which includes a rear roller which is attached to the link, which roller is adapted to engage the ramp as the front and rear slide panels move between the extended position and the retracted position, wherein the link, the front and rear rollers and the ramp are arranged so that when the packer face plate is in the forward position, the slide panel assembly is in the retracted position, and wherein the link, the front and rear rollers and the ramp are arranged so that when the packer face plate is in the rearward position, the slide panel assembly is in the extended position and covers at least a substantial portion of the top of the collection compartment forward of the packer face plate.

6. The spill shield assembly of claim 5 wherein the link, the front and rear rollers and the ramp are arranged so that when the packer face plate is in the forward position, the slide panels are disposed at an angle of about 45° from the horizontal in the retracted position.

7. The spill shield assembly of claim 1 which includes:

(a) a pair of ramps, each of which is attached to one of the side walls of the collection compartment;

(b) a pair of front rollers which are attached to the front slide panel and adapted to engage the ramps as the front and rear slide panels move between the extended position and the retracted position;

(c) a pair of links, each having a front end and a rear end, wherein the front end of each link is pivotally attached to the front slide panel and the rear end of each link is pivotally attached to the packer face plate.

8. The spill shield assembly of claim 7 which includes a pair of brackets, one of which is attached at each side of the forward end of the front slide panel, with each of said brackets being provided:

(a) for attachment of a front roller thereto so that by such attachment, the front roller is attached to the front slide panel;

(b) for pivotal attachment of the front end of a link thereto behind the front roller so that by such attachment, the front end of the link is attached to the front slide panel.

9. The spill shield assembly of claim 7 wherein the ramps are disposed at an angle of about 45° from the horizontal.

10. A spill shield assembly for a refuse collection vehicle, said vehicle having:

(a) a refuse collection compartment that is defined in part by a pair of side walls;

(b) a refuse storage compartment that is located adjacent to the refuse collection compartment;

(c) a container-lifting assembly which is adapted to lift a container into a position over the collection compartment so that the contents of the container may be dumped into the collection compartment;

(d) a packer ram assembly including:

(i) a packer face plate;

(ii) a hydraulic cylinder that is adapted to move the packer face plate across at least a substantial portion of the collection compartment between a forward position in which the packer face plate is disposed at the side of the collection compartment opposite the storage compartment and a rearward position in which the packer face plate is disposed adjacent to the storage compartment;

said spill shield assembly comprising:

(e) a slide panel assembly comprising:

(i) a rear slide panel which is pivotally mounted to the top of the packer face plate and which includes a guide receiver; and (ii) a front slide panel which includes a guide that is adapted to engage with and slide within the receiver of the rear slide panel, so that the front slide panel slides over the rear slide panel between an extended position in which the slide panels are disposed generally horizontally when the packer face plate is in a rearward position and a retracted position in which the slide panels are overlapped and are disposed at an angle so as to direct any material falling thereon into the collection compartment when the packer face plate is in a forward position;

(f) a pair of brackets, one of which is attached at each side of the forward end of the front slide panel;

(g) a pair of ramps, each of which is attached to one of the side walls of the collection compartment;

(h) a pair of front rollers, one of which is attached to each bracket so that each roller engages the ramps as the front and rear slide panels move between the extended position and the retracted position;

(i) a pair of links, each having a front end and a rear end, wherein the front end of each link is pivotally attached to one of the brackets behind the front roller and the rear end of each link is pivotally attached to the packer face plate;

(j) a pair of rear rollers, one of which is attached to each link, which rollers are adapted to engage the ramps as the front and rear slide panels move between the extended position and the retracted position;

wherein the links, the front and rear rollers and the ramps are arranged so that when the packer face plate is in the forward position, the slide panel assembly is in the retracted position and does not interfere with the movement of the container-lifting assembly or the dumping of refuse from the container; and wherein the links, the front and rear rollers and the ramps are arranged so that when the packer face plate is in the rearward position, the slide panel assembly is in the extended position and covers a substantial portion of the top of the collection compartment forward of the packer face plate.

11. The spill shield assembly of claim 10 wherein the links, the front and rear rollers and the ramps are arranged so that when the packer face plate is in the forward position, the slide panels are disposed at an angle of about 45° from the horizontal in the retracted position.

12. The spill shield assembly of claim 10 wherein the each of the links comprises a front component and a rear component and wherein the links, the front and rear rollers and the ramps are arranged so that when the packer face plate is in the rearward position, the slide panels are generally horizontally disposed in the extended position with the front component generally horizontally disposed and the rear component generally disposed at an angle of about 45° from the horizontal.

13. A spill shield assembly for a refuse collection vehicle, said vehicle having:

(a) a refuse collection compartment that is defined in part by a pair of side walls;

(b) a refuse storage compartment that is located adjacent to the refuse collection compartment;

(c) a packer ram assembly including:

(i) a packer face plate;

(ii) a force-applying mechanism that is adapted to move the packer face plate across at least a substantial portion of the collection compartment between a forward position in which the packer face plate is disposed at the side of the collection compartment opposite the storage compartment and a rearward position in which the packer face plate is disposed adjacent to the storage compartment;

said spill shield assembly comprising:

(d) a slide panel assembly comprising a front slide panel and a rear slide panel, wherein one of the front and rear slide panels is adapted to slide over the other between an extended position, in which the slide panels cover a substantial portion of the top of the collection compartment forward of the packer face plate when the packer face plate is in a rearward position, and a retracted position, in which the slide panels are overlapped and are disposed at an angle so as to direct any material falling thereon into the collection compartment when the packer face plate is in a forward position;

(e) a link having a front end and a rear end, wherein the front end of the link is pivotally attached to the slide panel assembly and the rear end of the link is pivotally attached to the packer face plate, so that when the packer face plate is in the forward position, the slide panel assembly is in the retracted position, and when the packer face plate is in the rearward position, the slide panel assembly is in the extended position.

14. The spill shield assembly of claim 13 wherein the front slide panel is adapted to slide over the rear slide panel between an extended position in which the front slide panel and the rear slide panel are disposed generally horizontally and a retracted position in which the front slide panel overlaps the rear slide panel.

15. The spill shield assembly of claim 13 wherein the link comprises a front component and a rear component and wherein the front component is generally horizontally disposed and the rear component is generally disposed at an angle of about 45° from the horizontal when the slide panels are in the extended position.

16. The spill shield assembly of claim 13, which includes:

(a) a ramp which is mounted on the forward side of the collection compartment;

(b) a front roller which is attached to the front slide panel and adapted to engage the ramp as the front and rear slide panels move between the extended position and the retracted position;

(c) a link having a front end and a rear end, wherein the front end of the link is pivotally attached to the front slide panel and the rear end of the link is pivotally attached to the packer face plate;

wherein the link, the front roller and the ramp are arranged so that when the packer face plate is in the forward position, the slide panel assembly is in the retracted position; and wherein the link, the front roller and the ramp are arranged so that when the packer face plate is in the rearward position, the slide panel assembly is in the extended position and covers a substantial portion of the top of the collection compartment forward of the packer face plate.

17. The spill shield assembly of claim 16 wherein:

(a) the vehicle includes a front-mounted container-lifting assembly which is adapted to lift a container into a position over the collection compartment so that the contents of the container may be dumped into the collection compartment; and (b) the link, the front roller and the ramp are arranged so that when the packer face plate is in the forward position, the slide panel assembly does not interfere with the movement of the container-lifting assembly or the dumping of refuse from the container.

18. The spill shield assembly of claim 16 which includes a rear roller which is attached to the link, which roller is adapted to engage the ramp as the front and rear slide panels move between the extended position and the retracted position, wherein the link, the front and rear rollers and the ramp are arranged so that when the packer face plate is in the forward position, the slide panel assembly is in the retracted position, and wherein the link, the front and rear rollers and the ramp are arranged so that when the packer face plate is in the rearward position, the slide panel assembly is in the extended position and covers at least a portion of the top of the collection compartment forward of the packer face plate.

19. The spill shield assembly of claim 18 wherein the link, the front and rear rollers and the ramp are arranged so that when the packer face plate is in the forward position, the slide panels are disposed at an angle of about 45° from the horizontal in the retracted position.

* * * * *